US007877936B2

(12) United States Patent
Uffner et al.

(10) Patent No.: US 7,877,936 B2
(45) Date of Patent: Feb. 1, 2011

(54) PLASTIC UTILITY SHED ROOF SYSTEM

(75) Inventors: Michael Uffner, Napeville, IL (US); Jed Richardson, Batavia, IL (US)

(73) Assignee: Suncast Corporation, Batavia, IL (US)

( * ) Notice: Subject to any disclaimer, the term of this patent is extended or adjusted under 35 U.S.C. 154(b) by 942 days.

(21) Appl. No.: 11/317,417

(22) Filed: Dec. 22, 2005

(65) Prior Publication Data

US 2007/0157530 A1 Jul. 12, 2007

Related U.S. Application Data

(63) Continuation of application No. 11/216,929, filed on Aug. 30, 2005, now Pat. No. 7,581,357.

(51) Int. Cl.

| | |
|---|---|
| ***E04H 1/12*** | (2006.01) |
| ***E04H 1/00*** | (2006.01) |
| ***E04B 2/08*** | (2006.01) |
| *E04H 5/08* | (2006.01) |

(52) U.S. Cl. ..... 52/90.1; 52/79.5; 52/79.1; 52/79.9; 52/588.1

(58) Field of Classification Search ..... 52/79.5, 52/79.1, 79.9, 79.12, 79.13, 90.1, 92.1–92.3, 52/578, 580, 581, 588.1, 589.1, 591.1, 591.5, 52/533; 403/263, 377, 286, 292, 294, 298, 403/326, 329, 409.1; 454/364–366

See application file for complete search history.

(56) References Cited

U.S. PATENT DOCUMENTS

| | | | | |
|---|---|---|---|---|
| 3,866,381 | A | 2/1975 | Eschbach et al. | |
| 4,557,091 | A | 12/1985 | Auer | |
| 5,036,634 | A | 8/1991 | Lessard et al. | |
| 5,214,895 | A * | 6/1993 | Fifield | 52/533 |
| 5,277,011 | A * | 1/1994 | Serrano Martin | 52/588.1 |
| 5,381,638 | A * | 1/1995 | Andersson | 52/592.1 |
| D371,208 | S | 6/1996 | De Zen | |
| 6,185,878 | B1 * | 2/2001 | Bullard et al. | 52/79.5 |
| 6,250,022 | B1 * | 6/2001 | Paz et al. | 52/79.5 |
| 6,282,858 | B1 * | 9/2001 | Swick | 52/533 |
| 6,298,616 | B1 * | 10/2001 | Mitchell et al. | 52/235 |
| 6,422,936 | B1 * | 7/2002 | Van Gilst et al. | 454/367 |
| 6,446,414 | B1 * | 9/2002 | Bullard et al. | 52/764 |
| 6,564,523 | B1 * | 5/2003 | Iole et al. | 52/521 |
| 6,591,558 | B1 * | 7/2003 | De Zen | 52/91.3 |
| 6,701,678 | B1 * | 3/2004 | Skov et al. | 52/79.9 |
| 6,782,672 | B2 * | 8/2004 | Staats | 52/591.2 |
| 6,796,087 | B1 * | 9/2004 | Greene | 52/32 |
| 7,509,776 | B2 * | 3/2009 | Reisman | 52/281 |
| 7,596,919 | B1 * | 10/2009 | Vande Hey et al. | 52/533 |
| 7,658,038 | B2 * | 2/2010 | Mower et al. | 52/79.1 |
| 7,770,334 | B2 * | 8/2010 | Mower et al. | 52/32 |
| 7,770,337 | B2 * | 8/2010 | Mower et al. | 52/79.1 |
| 7,770,339 | B2 * | 8/2010 | Mower et al. | 52/93.2 |
| 7,779,579 | B2 * | 8/2010 | Mower et al. | 52/79.1 |

(Continued)

*Primary Examiner*—Brian E Glessner
*Assistant Examiner*—Jason Holloway
(74) *Attorney, Agent, or Firm*—McHale & Slavin, P.A.

(57) ABSTRACT

The present invention provides a system which includes injection molded roof panels, header assemblies and ridge caps having integrated connectors which combine to form a family of variously sized roof assemblies for utility enclosures. The injection molding facilitates integrally formed connectors so that the roof panels, header assemblies and ridge caps interlock with one another without the need for separate connectors.

17 Claims, 22 Drawing Sheets

U.S. PATENT DOCUMENTS

2002/0174532 A1* 11/2002 Skov et al. ..... 29/453
2004/0187400 A1* 9/2004 Anderson et al. ..... 52/79.1
2004/0187402 A1* 9/2004 Moon et al. ..... 52/79.5
2005/0210761 A1* 9/2005 Mower et al. ..... 52/64
2005/0223655 A1* 10/2005 Mower et al. ..... 52/79.5
2006/0191209 A1* 8/2006 Reisman ..... 52/36.2

* cited by examiner

PLASTIC UTILITY SHED ROOF SYSTEM

RELATED APPLICATIONS

This application is a continuation of utility patent application Ser. No. 11/216,929 entitled Plastic Expandable Utility Shed filed Aug. 30, 2005, now U.S. Pat. No. 7,581,357 the contents of which are herein incorporated by reference in their entirety. This application is also related to Ser. No. 29/230,885 filed May 27, 2008, now U.S. Design Pat. No. D529,623, and Ser. No. 29/230,978 filed May 27, 2005, now U.S. Design Pat. No. D525,715, the contents of which are herein incorporated by reference in their entirety.

FIELD OF THE INVENTION

This invention relates generally to plastic utility sheds, and more specifically to a modular roof system constructed of injection molded plastic panels for creating plastic utility shed roofs of various sizes from standardized components.

BACKGROUND OF THE INVENTION

Utility sheds are necessary for lawn and garden care, as well as general all-around home storage space. Typically, items such as garden tractors, snow blowers, tillers, ATVs, motorcycles, lawn tools and the like are stored within utility sheds for the convenience of the homeowner.

The prior art has proposed a number of different panel systems, or kits, comprising blow molded and/or extruded panels which are combined with connector members for forming storage structures, e.g. utility sheds. Unfortunately, blow molding and/or extrusion of panels for utility sheds has resulted in shortcomings within the state of the art products. For example, due to the nature of the manufacturing process, blow molded and/or extruded plastic components cannot be formed with the intricate shapes and/or sharp corners required for integrated connectors. Therefore, these systems require extruded metal or plastic connector members having a specific cross-sectional geometry that facilitates an engagement between the blow molded or extruded panels to complete the structure.

A particularly common structure for the connector members is one having an I-beam cross section. The I-beam defines free edge portions of the connector member which fit within appropriately dimensioned and located slots in the panel members. U.S. Pat. No. D-371,208 teaches a corner extrusion for a building sidewall that is representative of the state of the art I-beam connector members. The I-beam sides of the connector engage with the peripheral edge channels of a respective panel and thereby serve to join such panels together at right angles. Straight or in-line versions of the connector members are also included in the kits to join panels in a coplanar relationship to create walls of varying length.

Another drawback associated with blow molded panels is the requirement of an inner and an outer wall. The inner and outer walls are a necessary product of the blow molding manufacturing process. While the inner wall may add some rigidity to the panels, it also adds a significant amount of weight and dramatically increases the volume of plastic necessary to form a panel of a given size when compared to other methods of manufacturing, such as injection molding.

A further drawback associated with blow molded panels relates to accurate control of wall thickness throughout the panels. The blow molding process does not allow the wall thickness of the panels to be accurately controlled. Once the molten plastic is conveyed to the tooling, there is minimal control over where the plastic flows during formation of the panel. Also, the blow molding process does not allow the intentional formation of thick and thin sections within a single panel for engineered rigidity at the points of high stress or high load concentration.

Extruded panels generally require hollow longitudinal conduits for strength. Due to the nature of the manufacturing process, the conduits are difficult to extrude in long sections for structural panels. Thus, they also require connectors to achieve adequate length for utility shed roofs. A common structure for connecting extruded members has a center I-beam with upper and lower protrusions for engaging the conduits. Wall panels utilizing these connectors are vulnerable to buckling under loads and may have an aesthetically unpleasing appearance. Moreover, roof loads from snow and the like may cause such walls to bow outwardly due to the clearances required between the connectors and the internal bores of the conduits. U.S. Pat. No. 6,250,022 discloses an extendable shed utilizing side wall connector members representing the state of the art. The connectors have a center strip with hollow protrusions extending from its upper and lower surfaces along its length; the protrusions being situated to slidably engage the conduits located in the side panel sections to create the height needed for utility shed walls.

The aforementioned systems can also incorporate roof and floor panels to form a freestanding enclosed structure such as a small utility shed. U.S. Pat. Nos. 3,866,381; 5,036,634; and 4,557,091 disclose various systems having inter-fitting panel and connector components. Such prior art systems, while working well, have not met all of the needs of consumers to provide the structural integrity required to construct larger sized structures.

Larger structures must perform differently than small structures. Large structures must withstand increased wind and snow loads when compared to smaller structures. Paramount to achieving these needs is a panel system which eliminates the need for extruded connectors to create enclosure walls which resist panel separation, buckling, and racking. A further problem is that the wall formed by the panels must tie into the roof and floor in such a way as to unify the entire enclosure. Also, from a structural standpoint, the enclosure should include components capable of withstanding the increased wind, snow, and storage loads required by large structures.

Therefore, what is needed in the art is an injection molded modular roof system for utility enclosures. The modular roof system should achieve objectives such as light weight single wall construction. The construction of the panels should eliminate the need for extruded I-beam connectors to create a roof assembly which resists panel separation, buckling, and racking. The roof assembly should be capable of withstanding the wind and snow loads typically associated with utility enclosure roofs.

There are also commercial considerations that must be satisfied by any viable utility shed enclosure system or kit; considerations which are not entirely satisfied by state of the art products. The roof assembly must be formed of relatively few component parts that are inexpensive to manufacture by conventional techniques. The roof assembly must also be capable of being packaged and shipped in a knocked-down state. In addition, the roof assembly must be modular and facilitate the creation of a family of roof assemblies that vary in size but which share common, interchangeable components.

Finally there are ergonomic needs that a roof assembly must satisfy to achieve acceptance by the end user. The roof assembly must be easily and quickly assembled using minimal hardware and requiring a minimal number of tools. In addition, the roof assembly must not require excessive strength to assemble or include heavy component parts. Moreover, the roof assembly must assemble together in such a way so as to not detract from the internal storage volume of the resulting enclosure or otherwise negatively affect the utility of the structure.

SUMMARY OF THE INVENTION

The present invention provides a system including injection molded roof panels, headers, and ridge caps having integrated connectors which combine to form a family of variously sized roofs for utility enclosures. The roof panels, headers, and ridge caps are formed of injection molded plastic to create light-weight components having integrally formed ribs and gussets for strength and integrity. The injection molding also facilitates integrally formed connectors so that the panels, headers and ridge caps interlock with one another without the need for separate connectors. In addition, the ridge caps and/or roof panels may be formed of translucent plastic for natural lighting.

Accordingly, it is a primary objective of the instant invention to provide a plastic utility roof assembly.

It is a further objective of the instant invention to provide a plastic roof assembly which utilizes roof panels and ridge caps having single wall construction with integrally formed ribs and gussets for a lightweight yet robust roof assembly.

It is yet another objective of the instant invention to provide a plastic roof assembly which accommodates injection molding plastic formation of the components for increased structural integrity.

It is a still further objective of the invention to provide a modular header system which allows standard components to be utilized for different width roofs.

Still another objective of the instant invention is to provide a roof system in which the components include integrally formed connectors.

Yet another objective of the instant invention is to provide a roof system which includes components having predetermined sizes for creating roofs of varying dimensions using common components.

Still yet another objective of the instant invention is to provide a roof assembly which reduces the number of components required to assemble a roof and simplifies construction.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
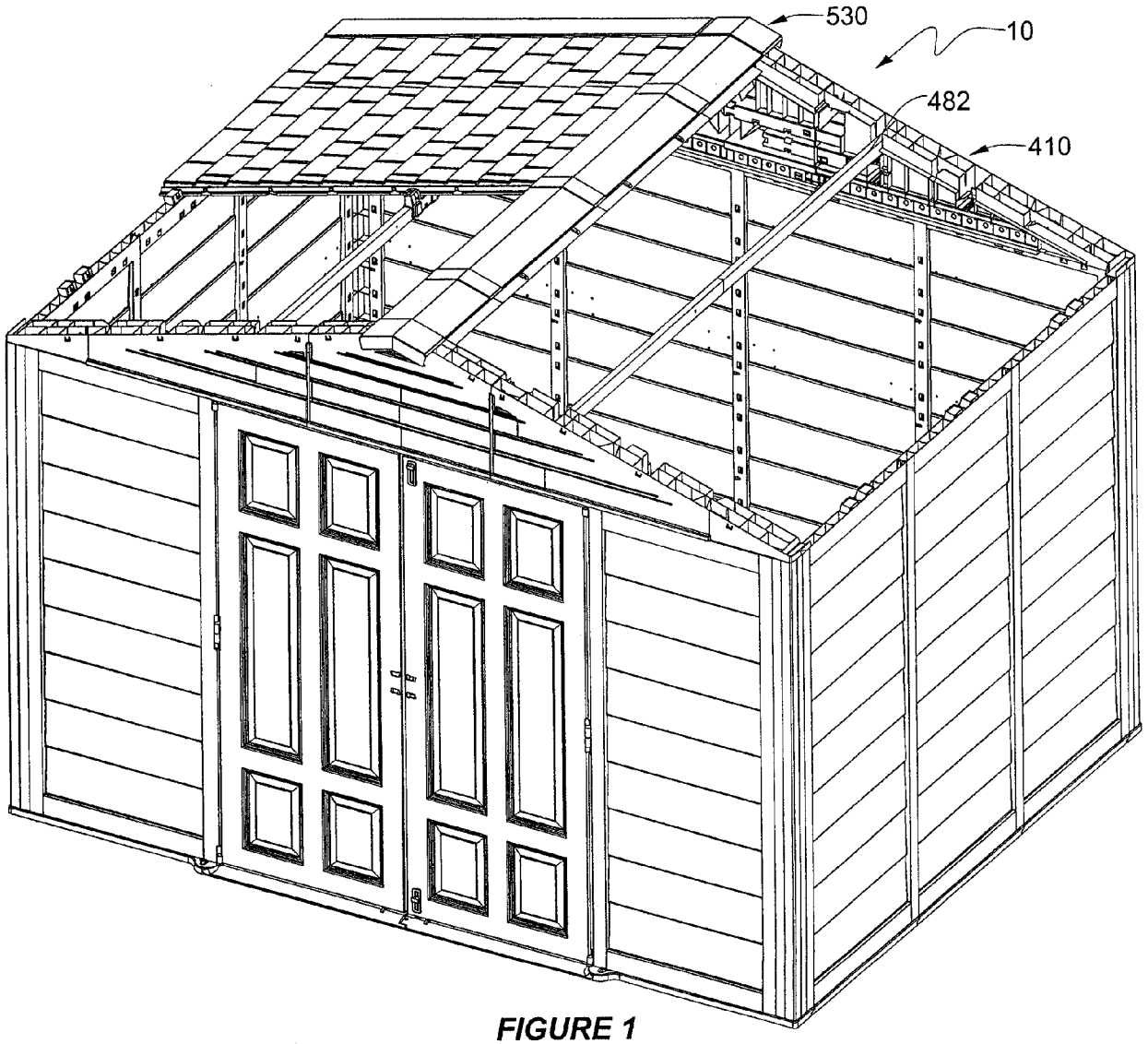
FIG. 1 is a front perspective view of an enclosure comprising an assembled wall system, roof headers, and a ridge cap.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Figure 2:
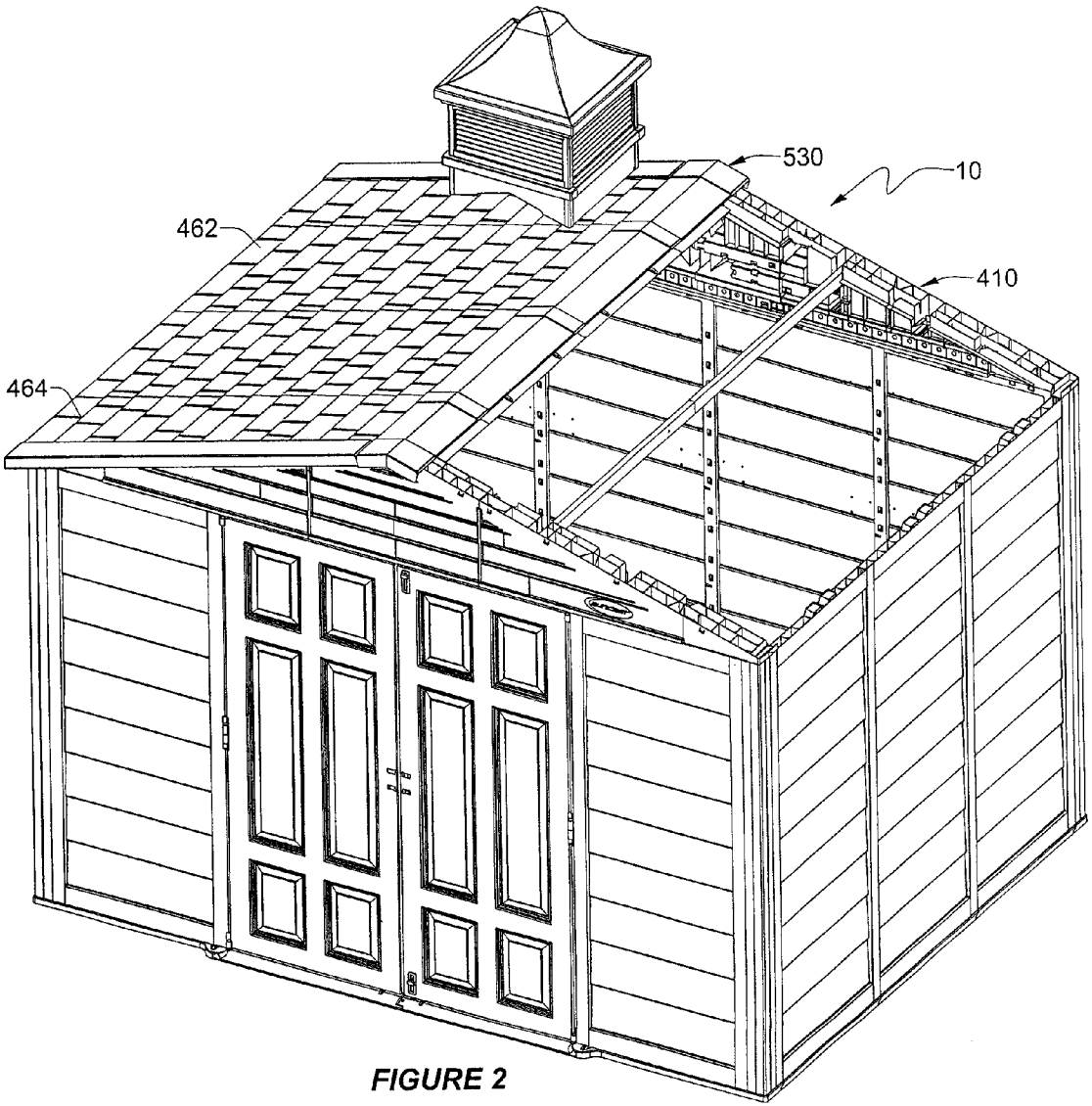
FIG. 2 is a front perspective view of an enclosure comprising an assembled wall system, headers and the left half of the roof assembly.
Figure 3:
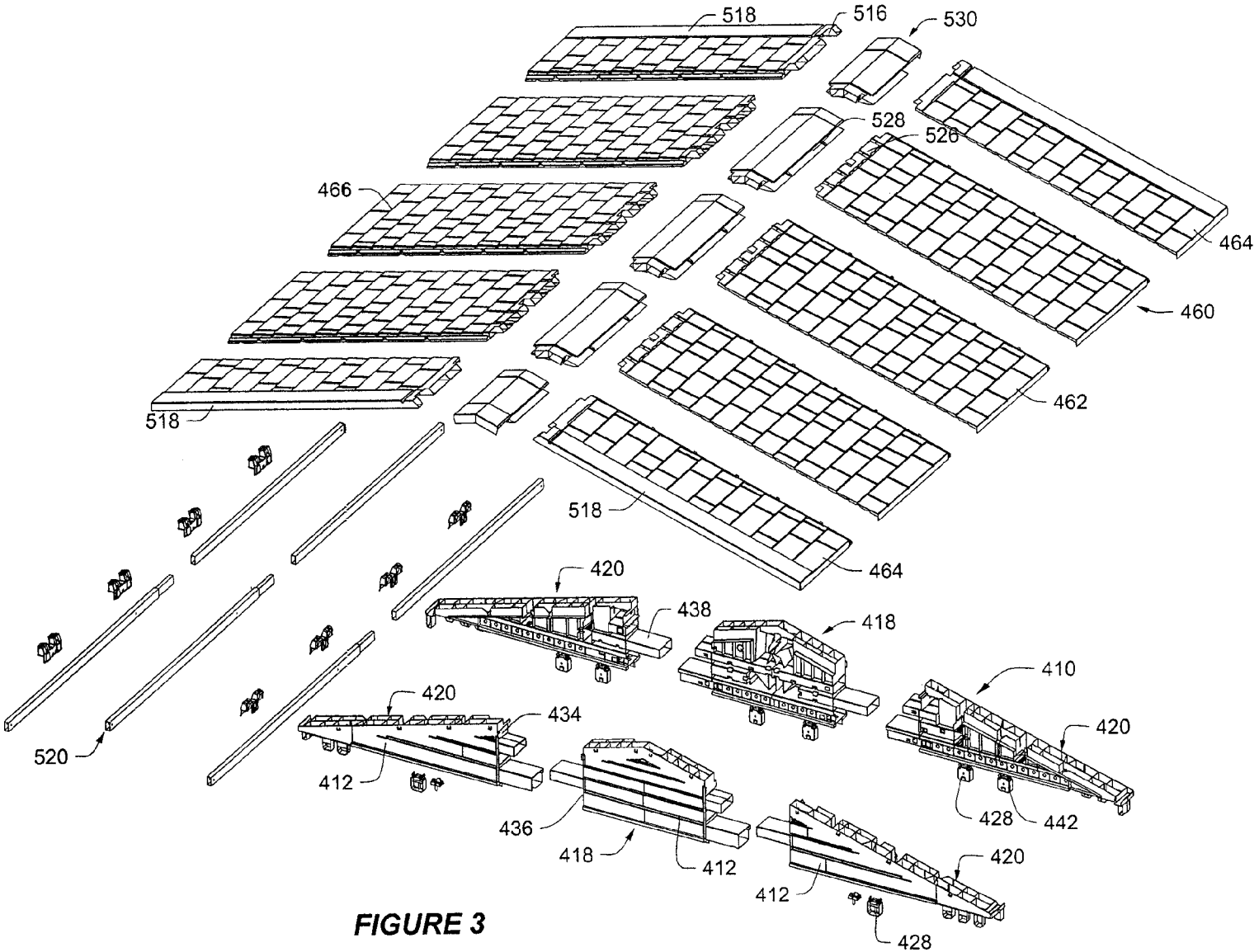
FIG. 3 is an exploded view of a complete roof assembly.

FIGS. 1-3 show perspective views of a heavy duty plastic utility enclosure, generally referenced as 10, constructed according to a preferred embodiment of the present invention. The roof assembly generally includes header assemblies 410, roof panels 460, roof supports 520, and a ridge cap assembly 530 which are shown in an exploded view in FIG. 3. The header assembly is a truss like structure molded with an aesthetically pleasing generally smooth wall 412 on its outer surface (FIGS. 3,6,7, and 9) and integrally formed box bracing 414 (FIGS. 4-9) and a plurality of pockets 416 constructed and arranged to accept roof support members 470 on its inner surface. In the preferred embodiment the header assembly is constructed of a center member 418 and a pair of outer members 420 (FIG. 3). This type of construction permits the center member to be added or removed to construct different size enclosures while the outer members remain the same. Each member of the header assembly includes an upper surface 422 and a lower surface 424. The lower surface 424 includes a plurality of inwardly extending engagement sockets 426 constructed and arranged to cooperate with removable and replaceable bosses 428 and/or door hinge pins 430. The bosses 428 or hinge pins 430 are slid into their respective engagement sockets 426 until the integrally formed spring tabs 432 (FIGS. 6 and 9) engage corresponding apertures formed in the engagement sockets. The end surfaces 434, 436 of the header members includes means to connect them together illustrated herein as a plurality of outwardly extending, inter-fitting tubes 438. The tubes are constructed and arranged to extend into a socket 439 formed in an adjacently positioned header member until integrally formed spring locks 440 (FIG. 8) engage a corresponding aperture. This construction provides a load distributing connection between the header members that prevents separation and bowing of the assembly under load. In addition, the design provides a sealed connection between the panels preventing weather and insect infiltration. The resultant header created by the combination of the interlocking members benefits from high structural integrity and reliable operation.

Figure 4:
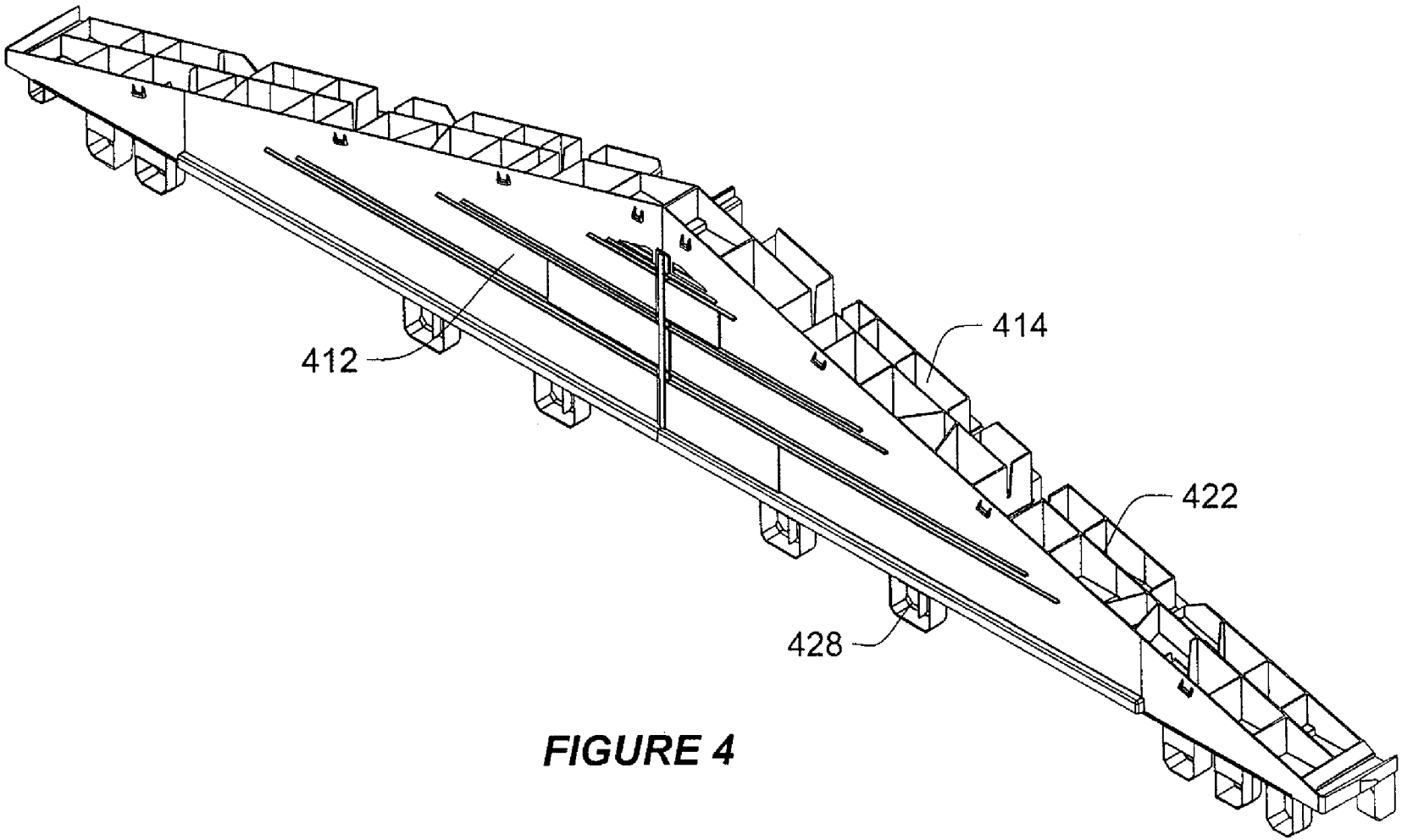
FIG. 4 is a front perspective view of a two piece header.
Figure 5:
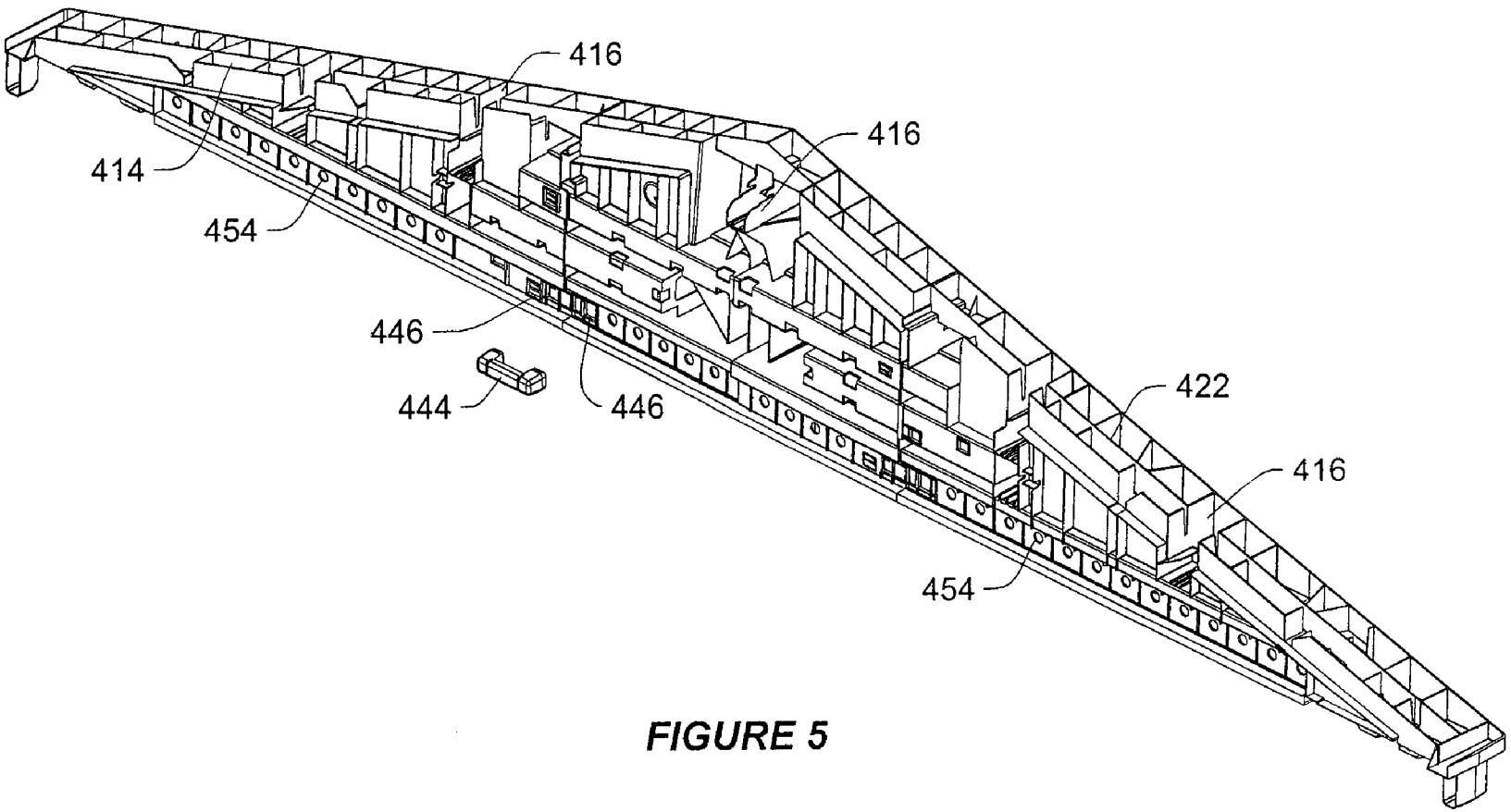
FIG. 5 is a rear perspective view of a two piece header.
Figure 6:
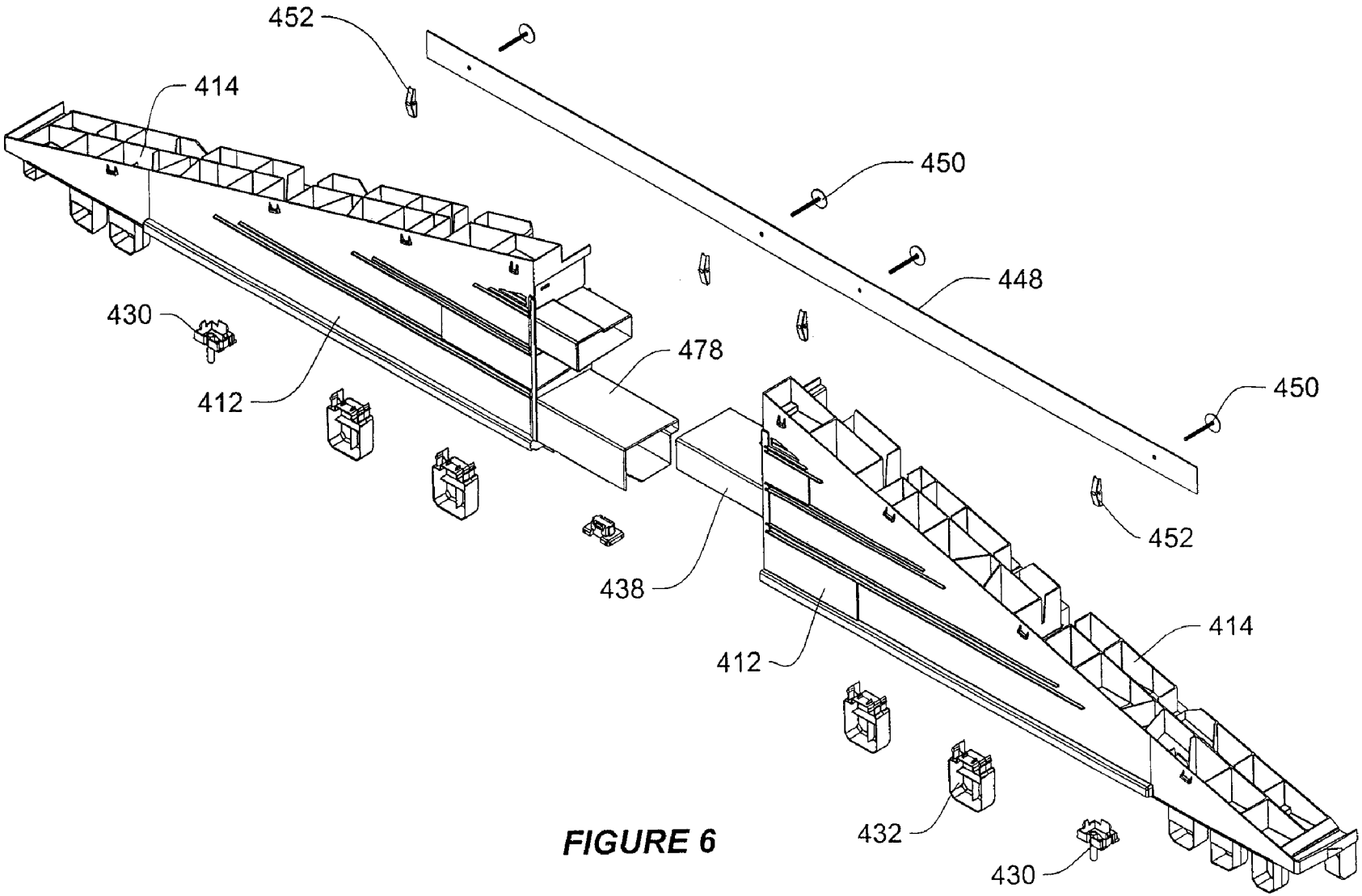
FIG. 6 is a front perspective exploded view of a two piece header with a strap support.
Figure 7:
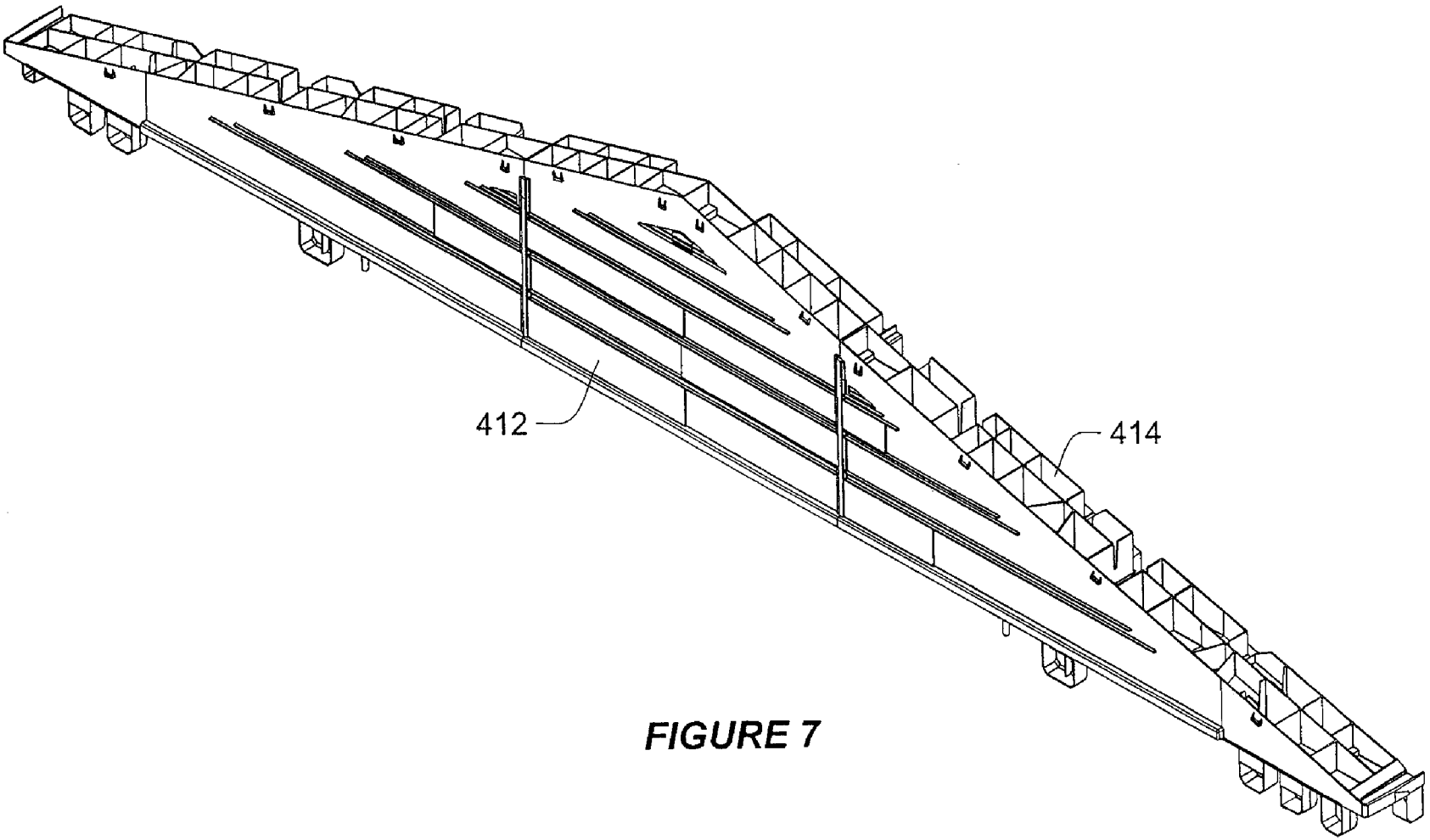
FIG. 7 is a front perspective view of a three piece header.
Figure 8:
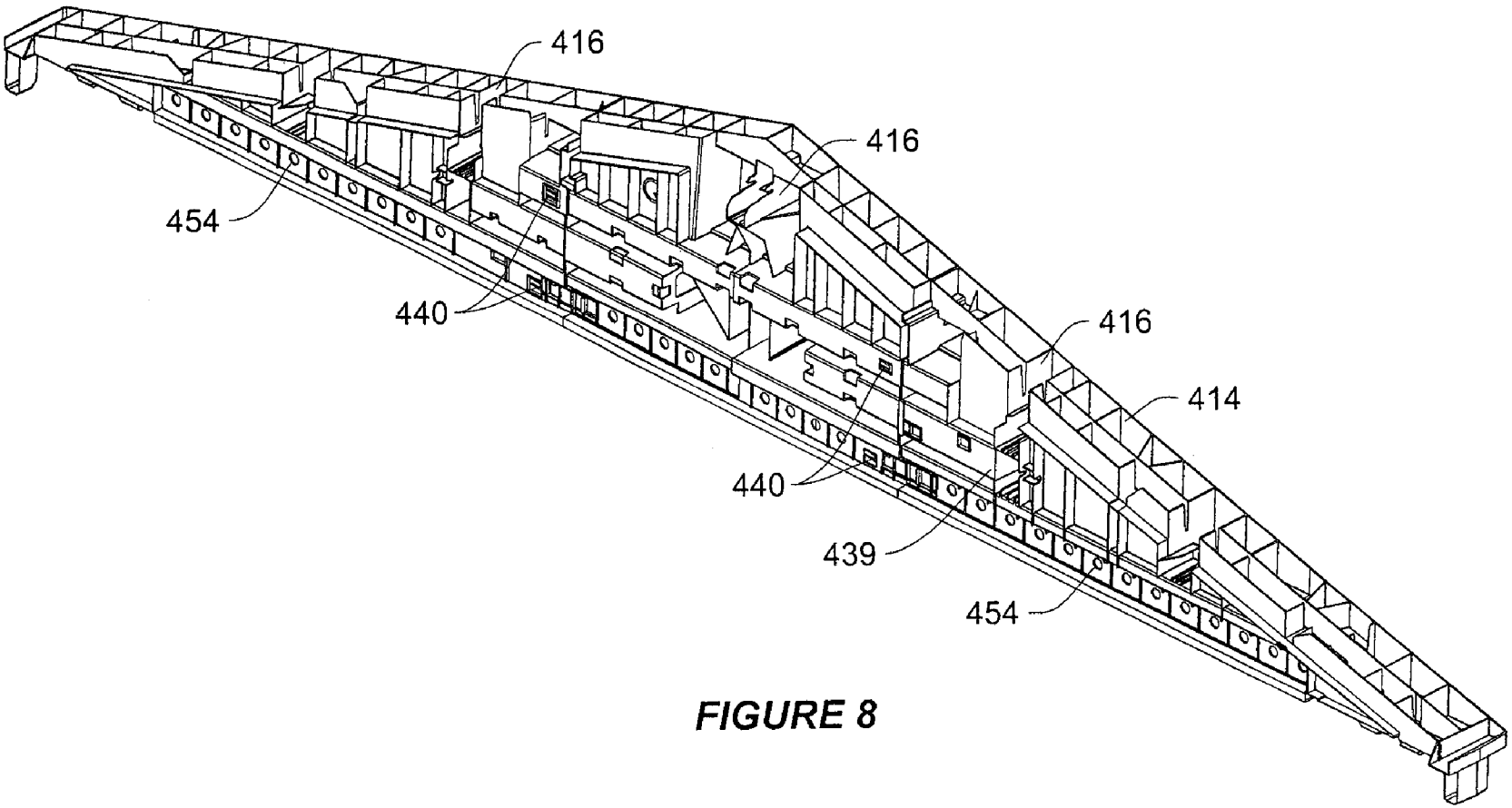
FIG. 8 is a rear perspective view of a three piece header.
Figure 9:
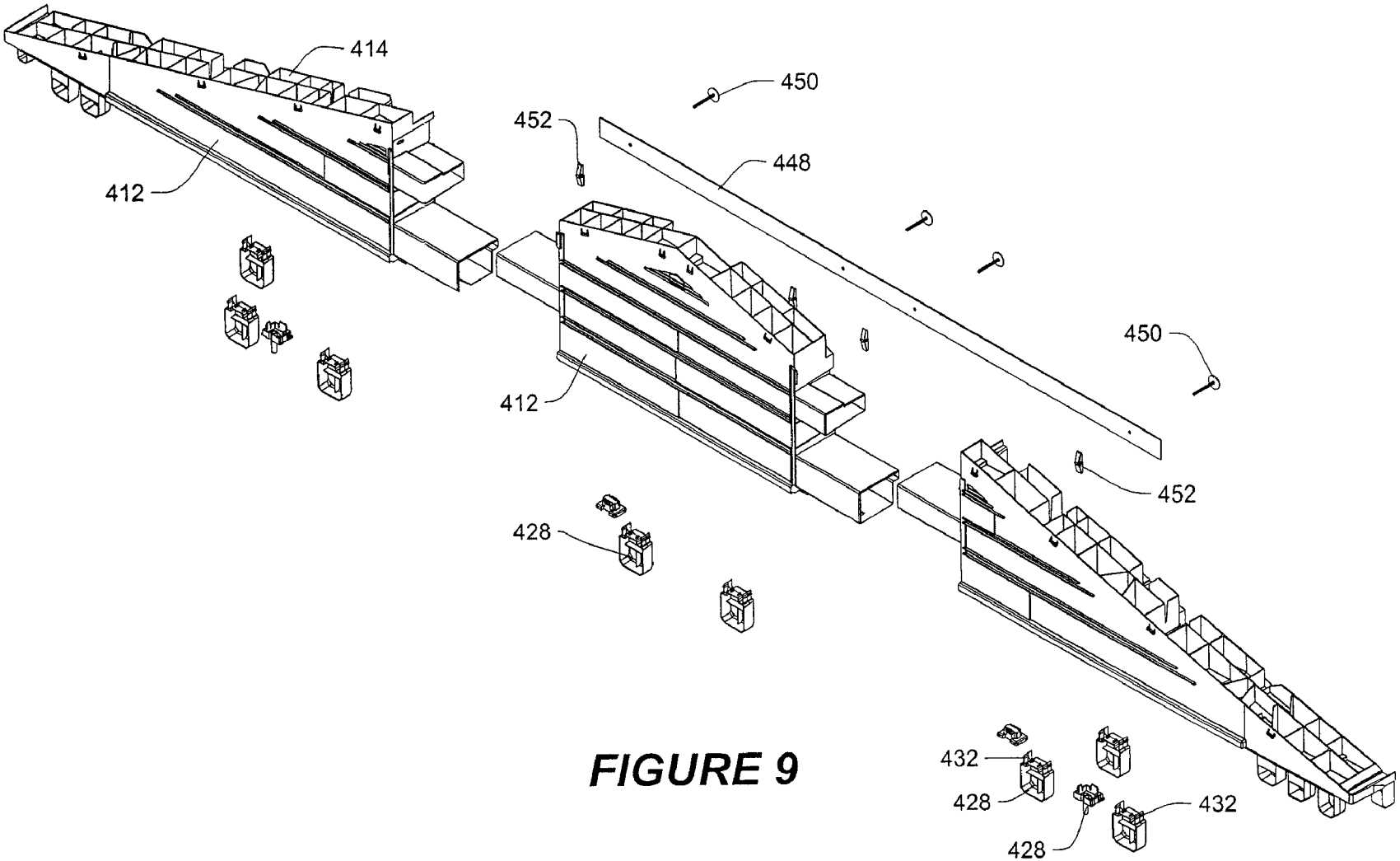
FIG. 9 is a front perspective exploded view of a three piece header with a strap support.
Figure 10:
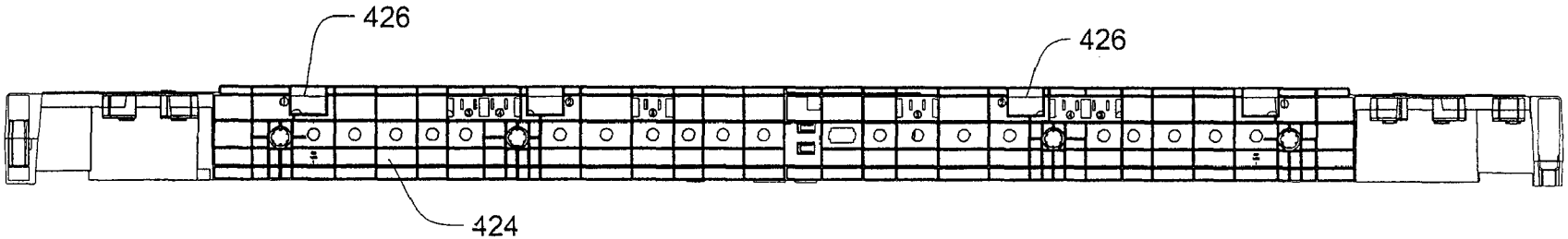
FIG. 10 is a bottom view of a three piece header.
Figure 11:
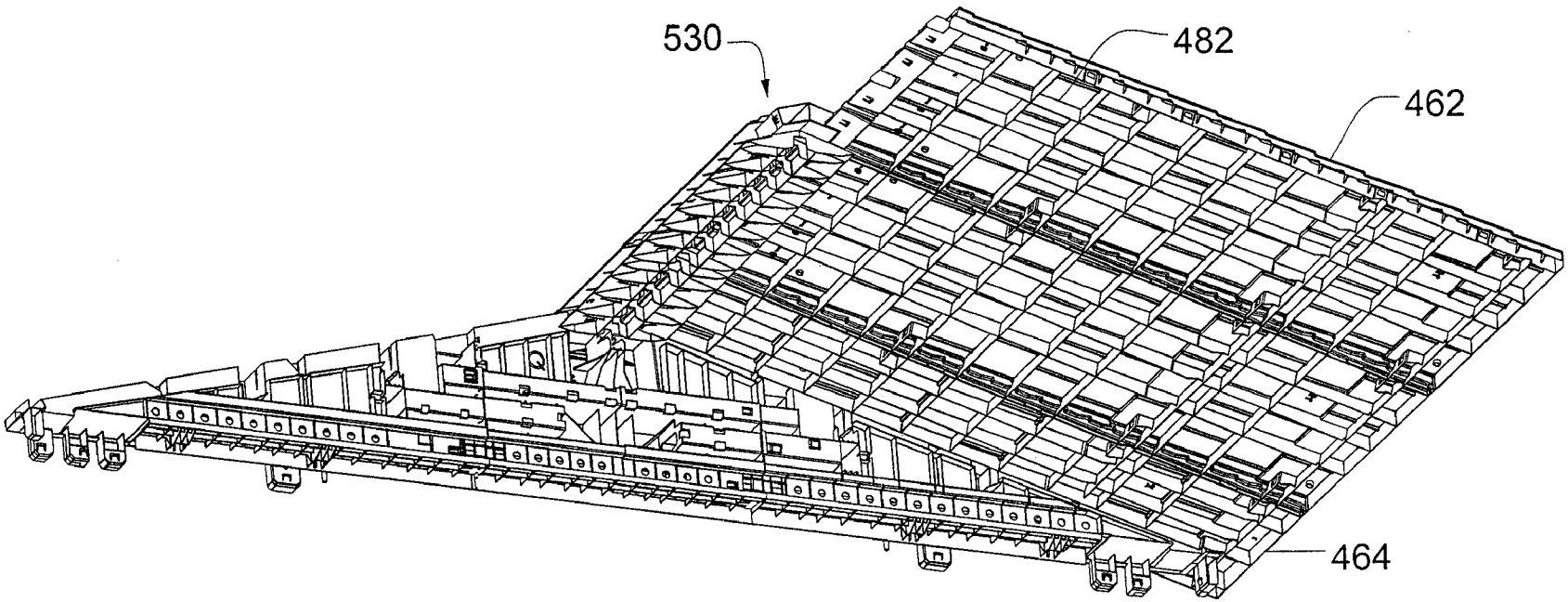
FIG. 11 is a perspective view of the back side of a header and the underside of the roof panels.

Referring to FIGS. 4-6, a two piece header embodiment is illustrated. With this embodiment additional means are provided for attaching the header members together illustrated herein as a C-shaped clip 444. The C-shaped clip is inserted into apertures 446 provided in each of the header members (FIG. 5). The C-shaped clip is provided to prevent separation and provide load support integrity to the header assembly. For additional support ad rigidity the header assembly is constructed and arranged to cooperate with a metal support member 448. The metal support member is attached to the header members with fasteners 450 and anchors 452. The anchors are inserted through the apertures 454 on the rear side of the header members (FIG. 5). In this manner FIGS. 8 and 9 show how the strap is employed with a three piece header assembly.

The headers are attached to the wall assemblies by sliding the bosses 428 into sockets (not shown) positioned in the top portion of the wall panels until the integrally formed spring clips 442 (FIG. 3) engage apertures formed in the sockets. The result is a positive lock that maintains alignment of the wall panels in the same plane and prevents bowing or bending of one panel relative to another one.

Referring to FIGS. 1-3 and 5, at least three roof supports 520 are inserted into their respective pockets 416 in each of the headers and may optionally be secured in place with suitable fasteners. The roof supports are preferably constructed of a metal such as steel, but may be constructed of other materials well known in the art capable of providing structural support to the roof assembly. Such materials may include but are not limited to wood and/or plastic as well a suitable combinations thereof. FIG. 1 illustrates the placement of the support beams in the headers of the preferred embodiment.

Figure 13:
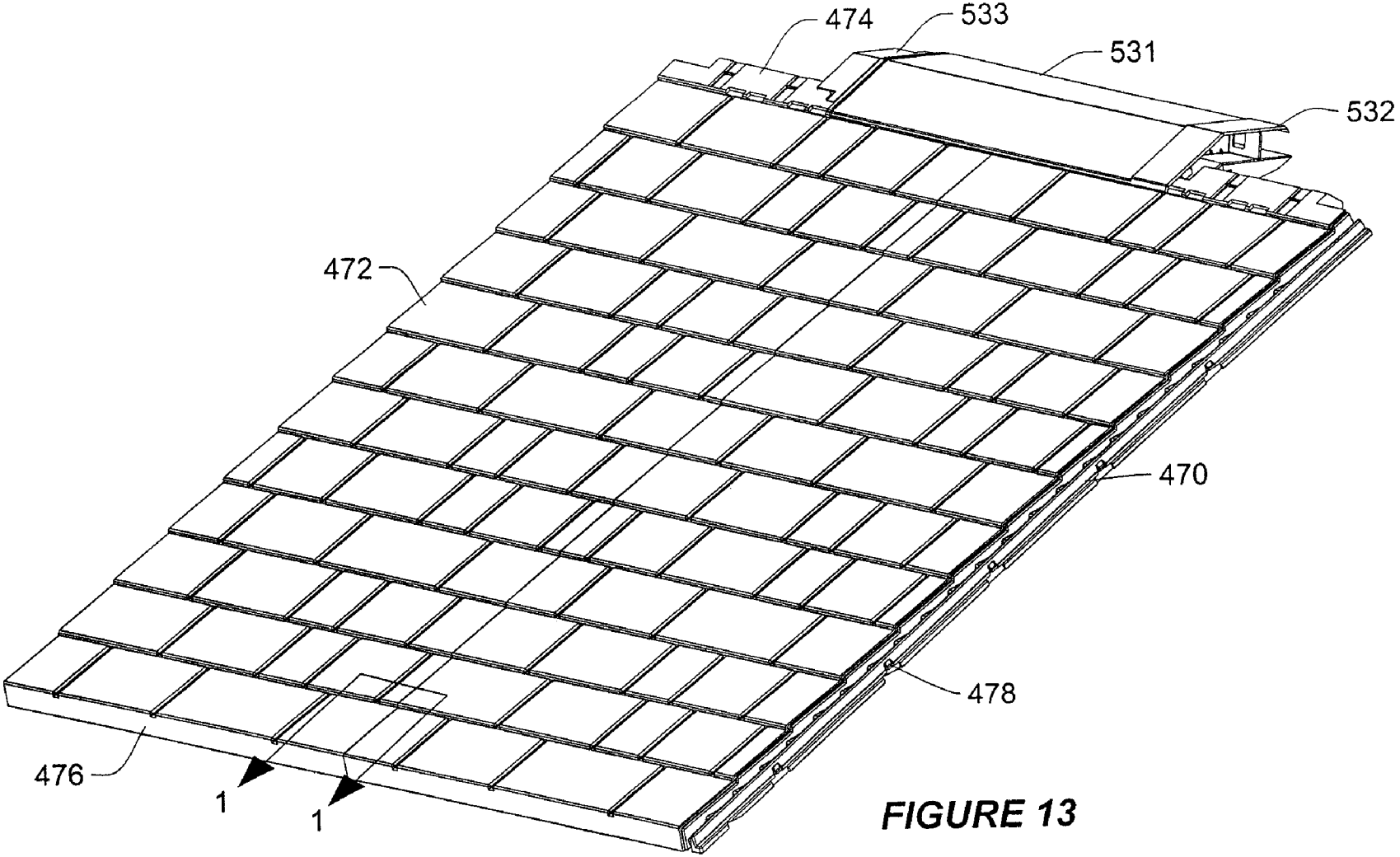
FIG. 13 is a perspective view of the top of the roof panels and a section of the ridge cap.
Figure 16:
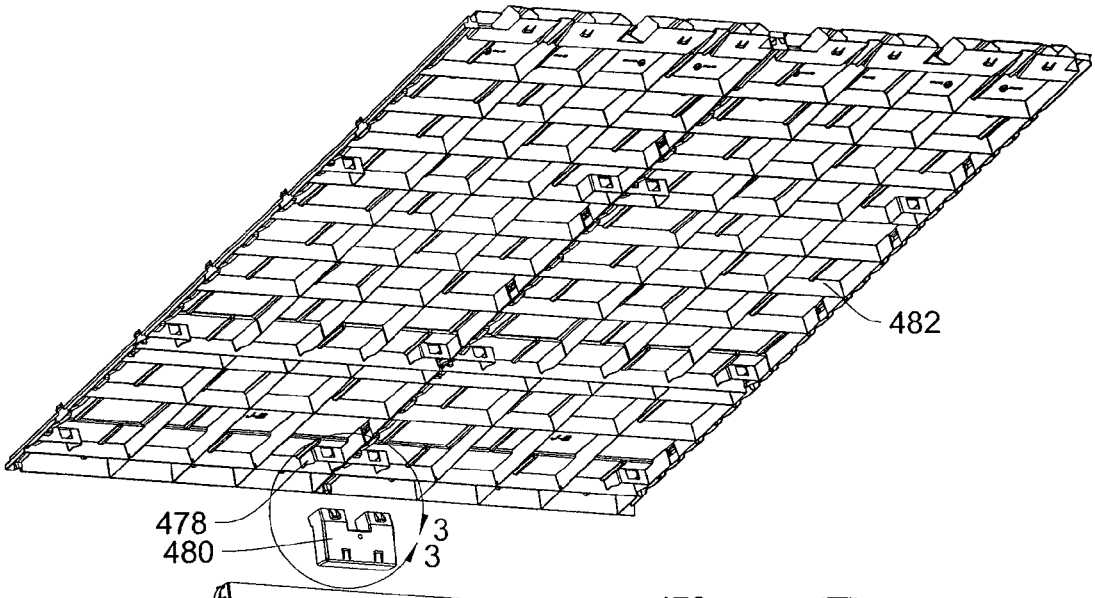
FIG. 16 is a perspective view of the connection between a roof panel and a wall panel.
Figure 16:
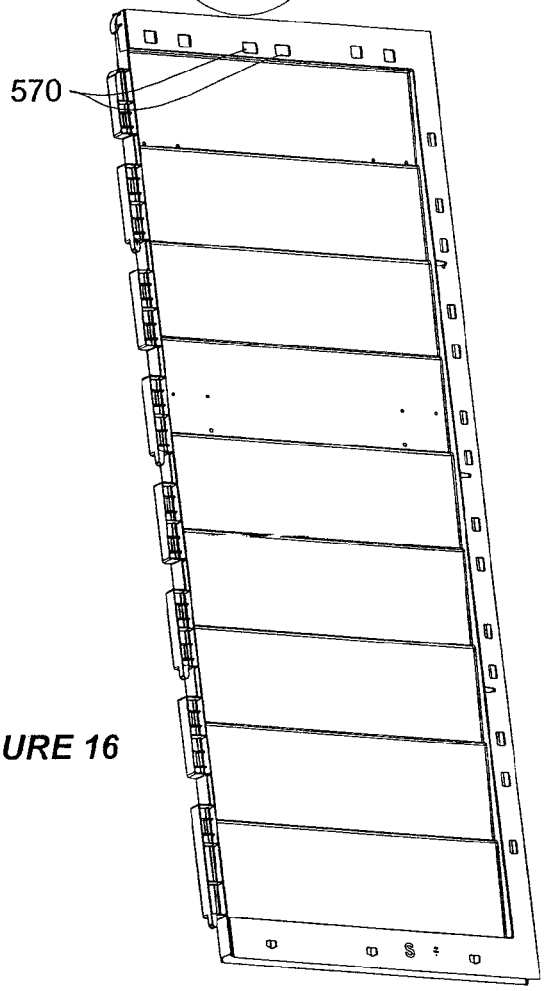
Figure 16A:
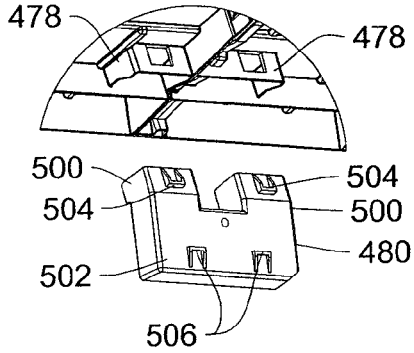
FIG. 16A is an enlarged view taken along line 3-3 of FIG. 16 illustrating the connector which joins a roof panel to a wall panel.
Figures 17, 17A:
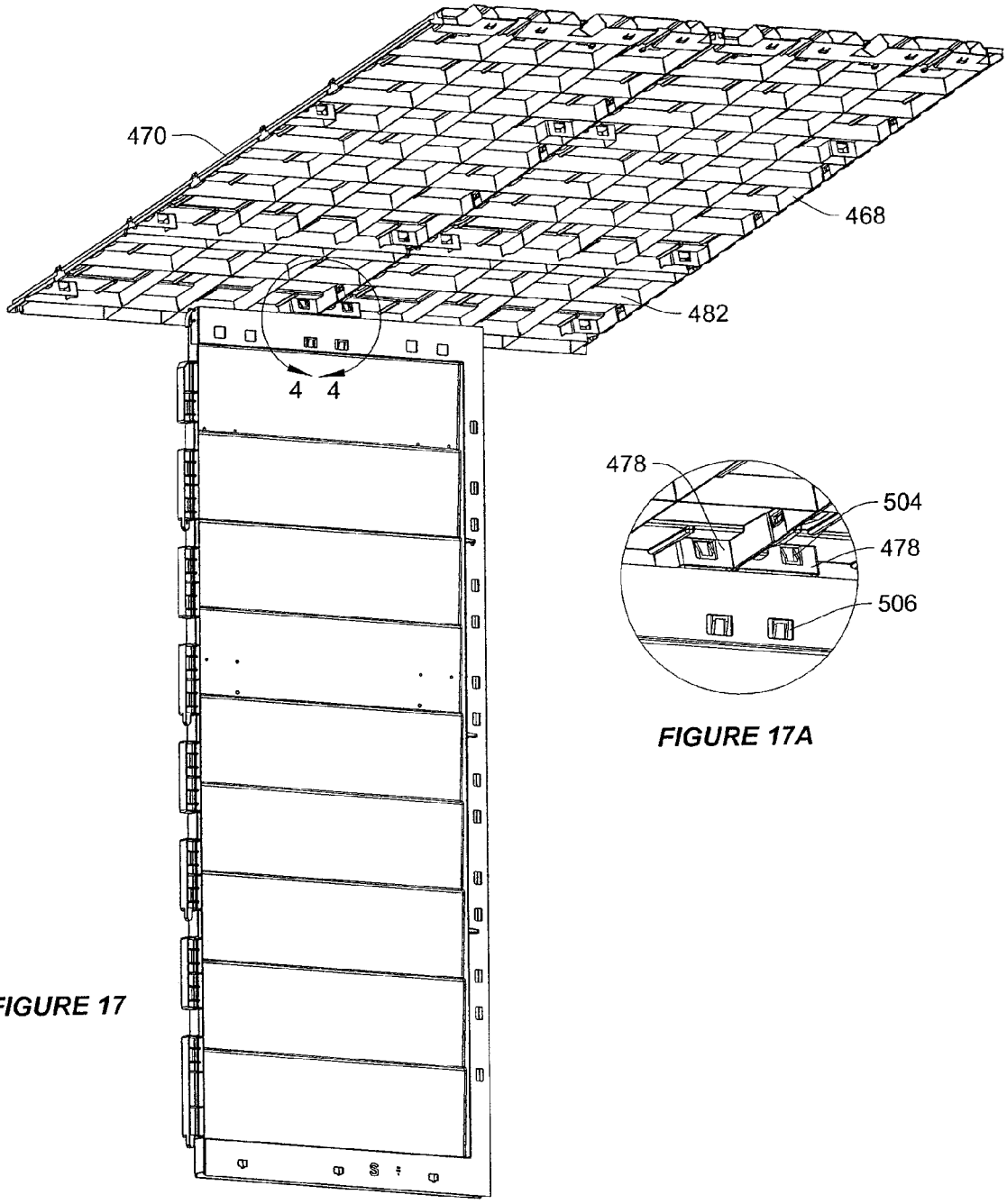
FIG. 17 is a perspective view of an assembled roof and wall panel.
FIG. 17A is an enlarged view taken along line 4-4 of FIG. 17 illustrating the assembled connection between a roof panel and a wall panel.
Figure 20:
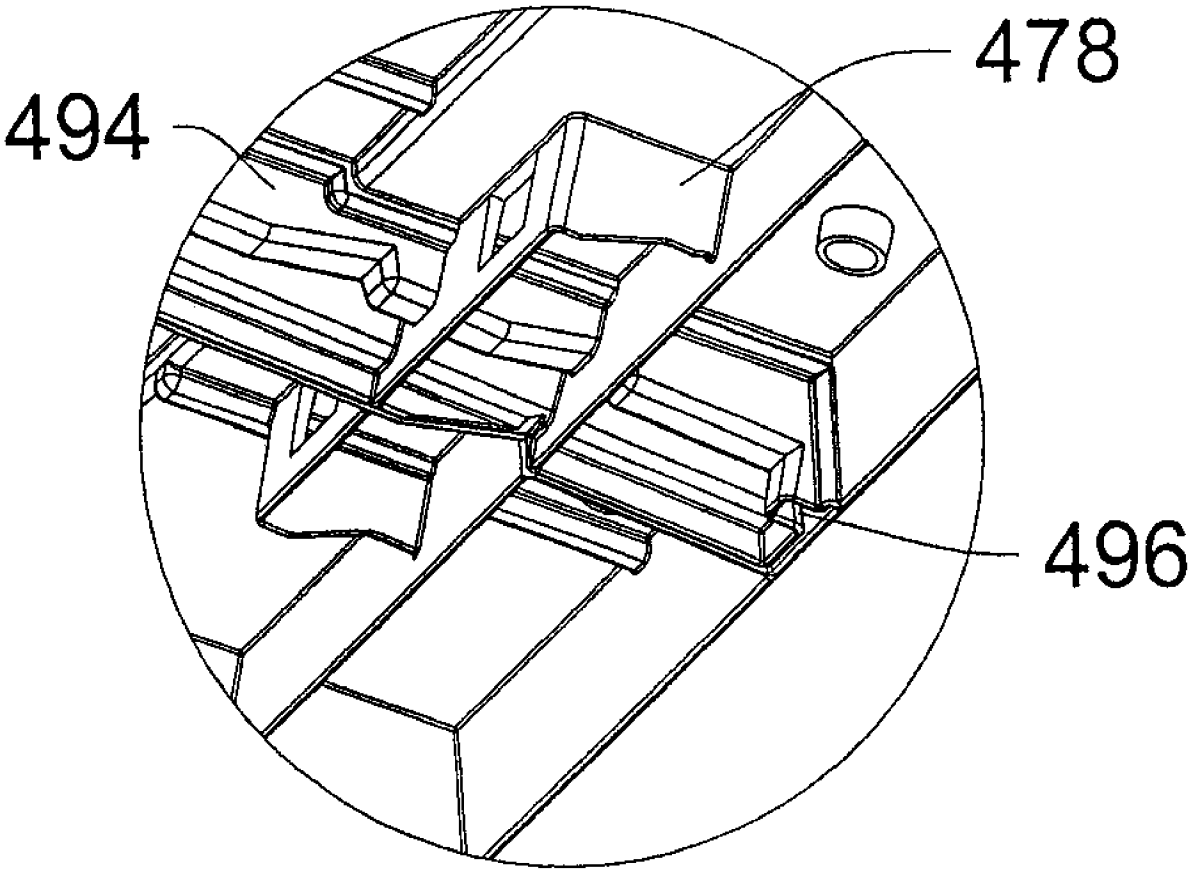
FIG. 20 is an enlarged view of the connection between two roof panels.
Figure 21:
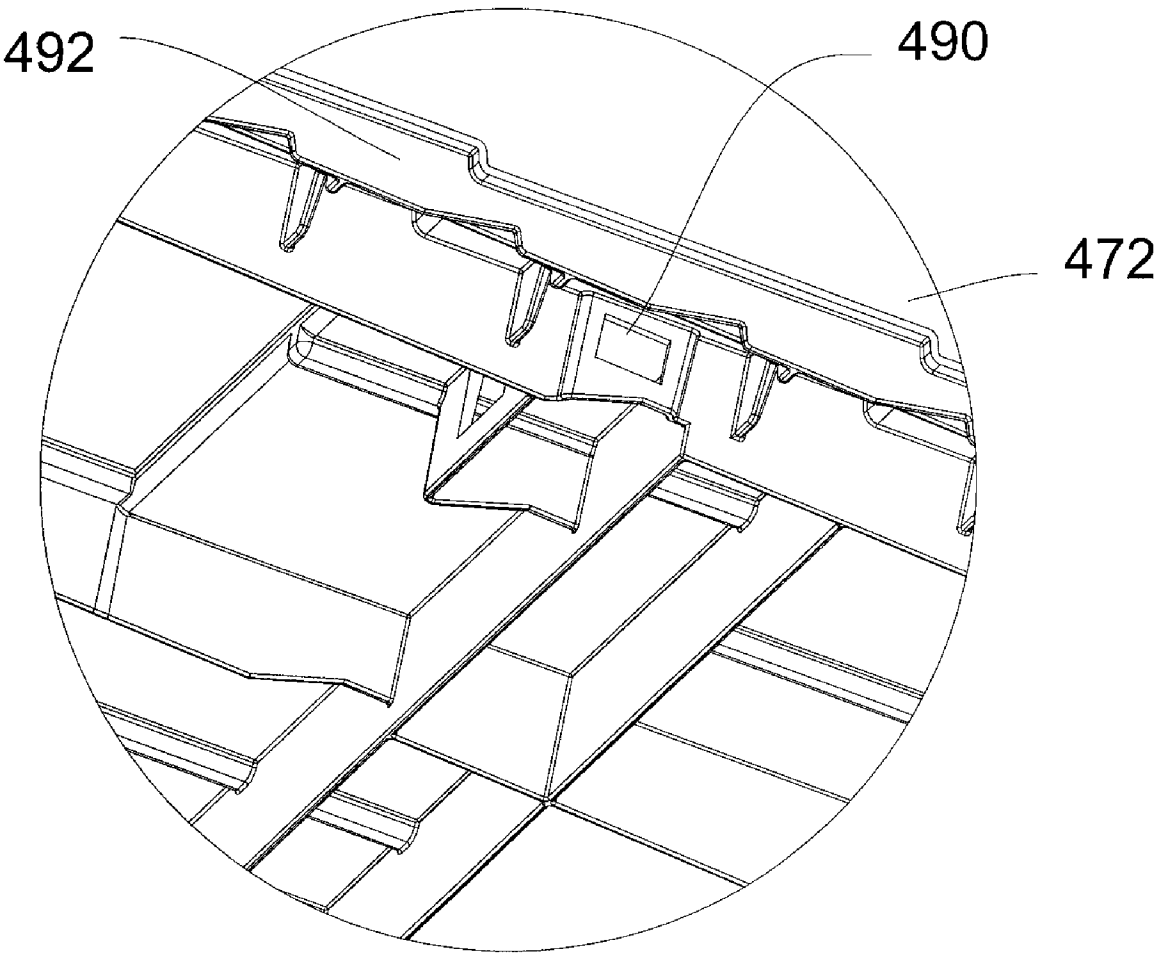
FIG. 21 is an enlarged view of one roof panel of the connection shown in FIG. 20.
Figure 22:
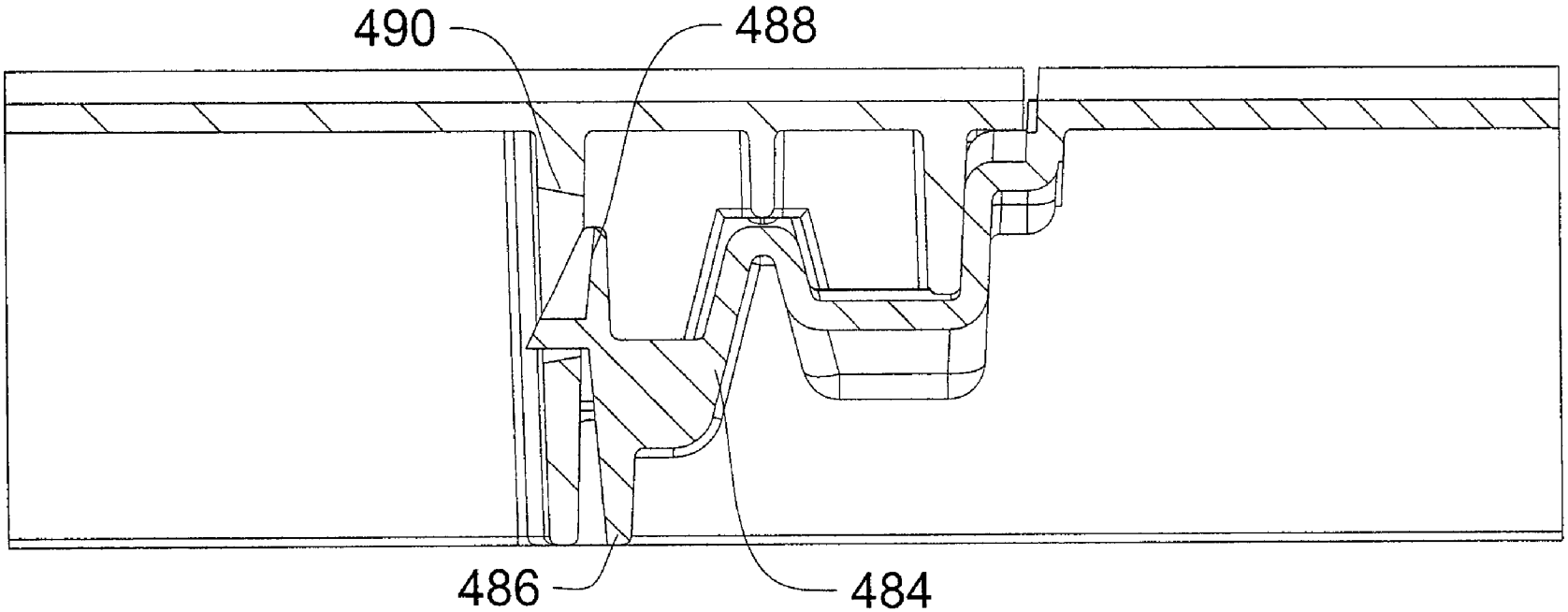
FIG. 22 is a section view taken along line 1-1 of FIG. 13 illustrating the overlapping connection between the roof panels.

Referring to FIGS. 3 and 13 roof panels 460 are formed as either a central roof panel 462 or an end roof panel 464. Each central roof panel has a top surface 466, a bottom surface 468, a first locking edge 470, a second locking edge 472, a third locking edge 474 and a closed edge 476. Along the bottom surface 468 adjacent to the closed edge 476 is another connection means illustrated herein as a plurality of sockets 478 constructed and arranged to receive roof connectors 480 (FIGS. 16 and 17). The roof connectors are constructed and arranged to cooperate with pockets (not shown) located in the top portion of the wall panels as well as the sockets 478 located on the lower surface of the roof panels. A series of spaced apart structural ribs 482 extend across the bottom surface of each roof panel to provide rigidity and increased weight carrying capacity to the roof assembly. The first 470 and second 472 locking edges of the roof panel include another connection means illustrated herein as a W-shaped overlapping connection 484 (FIG. 22). The distal portion 486 of the first locking edge 470 of the overlapping connection includes a plurality of ramp-locks 488 constructed and arranged to cooperate with apertures 490 formed into the second locking edge overlapping connection. The W-shaped overlapping connection provides a water resistant seal between the panels and prevents the panels from bowing or separating under wind or snow loads. The second locking edge 472 further includes a downwardly extending wave shaped rib 492 (FIG. 21). This rib is constructed and arranged to fit into a corresponding trough 494 formed on the first locking edge 470 (FIG. 20). The connection of the wave shaped rib 492 and corresponding trough 494 provides an additional water resistant seal between the panels. Any water that may enter the trough flows downwardly along the trough and out through drain 496 (FIG. 20). Drain 496 is located outside of the walls so that water is prevented from entering the enclosure.

Figures 18, 18A:
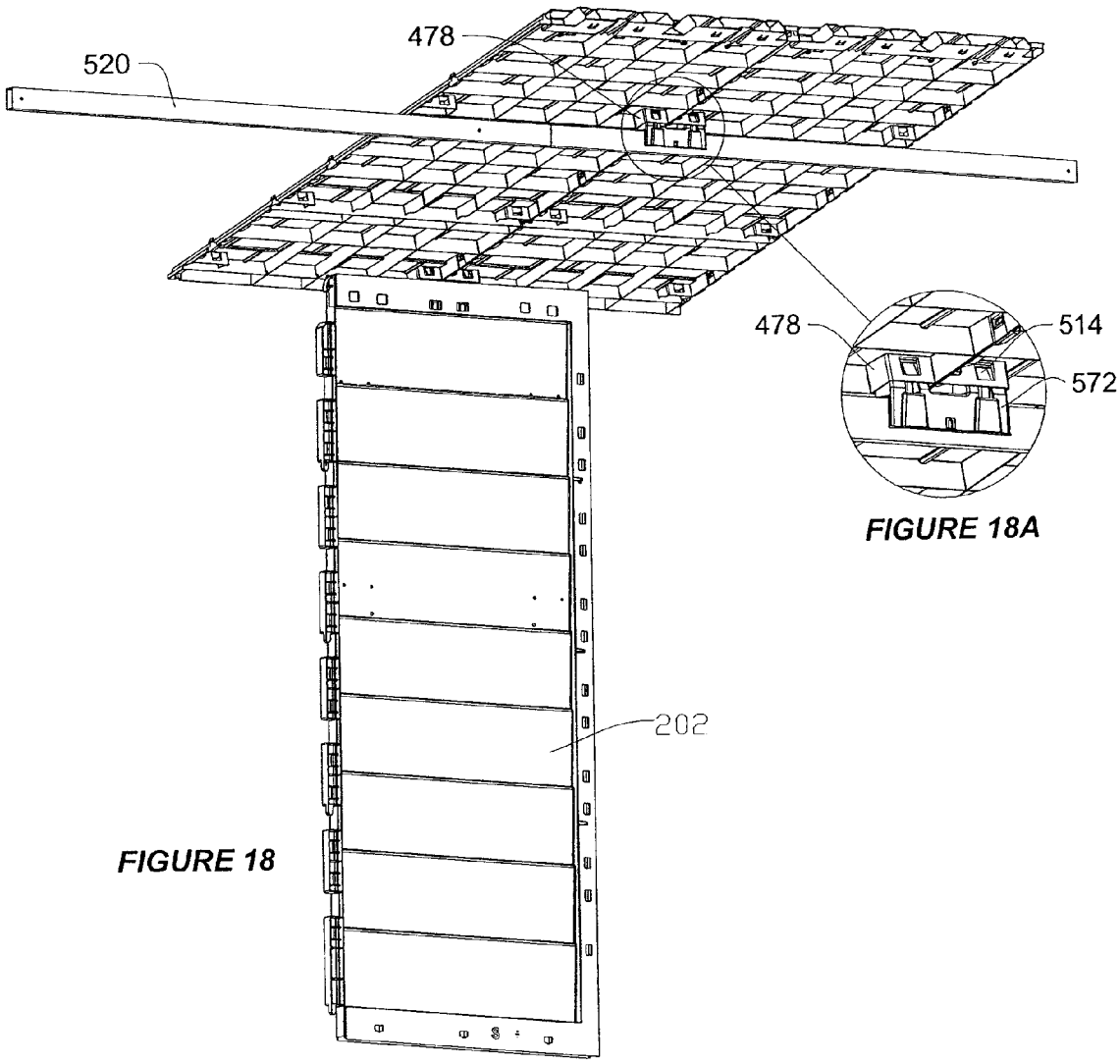
FIG. 18 is a perspective view of an assembled roof and wall panel including a roof support.
FIG. 18A is a enlarged view of the connector between a roof panel and the roof support.

Sockets 478 located on the lower surface of the roof panels comprise two sockets members (FIG. 20). Each socket member is located along a locking edge of a roof panel (FIGS. 16,17, and 20). Roof connectors 480 are formed with two upwardly extending members 500 and a lower member 502 which spans members 500. The upwardly extending members are provided with ramp-locks 504 and the lower member is provided with two ramp-locks 506. The connectors 480 are constructed and arranged to allow the upwardly extending members to slide into sockets 478 and the lower member to slide into a socket on the top portion of a wall panel (FIGS. 16 and 17). The ramp-locks engage apertures 508 in socket 478 and ramp-locks 506 engage apertures 510 in the wall panel socket. Another type of roof connector 512 also slides into sockets 478 which are located on the lower side of the roof panel and spaced between the ends of the roof panels as shown in FIG. 18. The lower portion of connector 512 is provided with a groove which engages roof supports 520 to provide support for the roof panel along its length. Connectors 512 are provided with ramp locks 514 which engage apertures 508 in sockets 478 to provide a locking connection. The connectors 512 and roof supports 520 provide roof support for additional snow loads.

Figures 12, 12A:
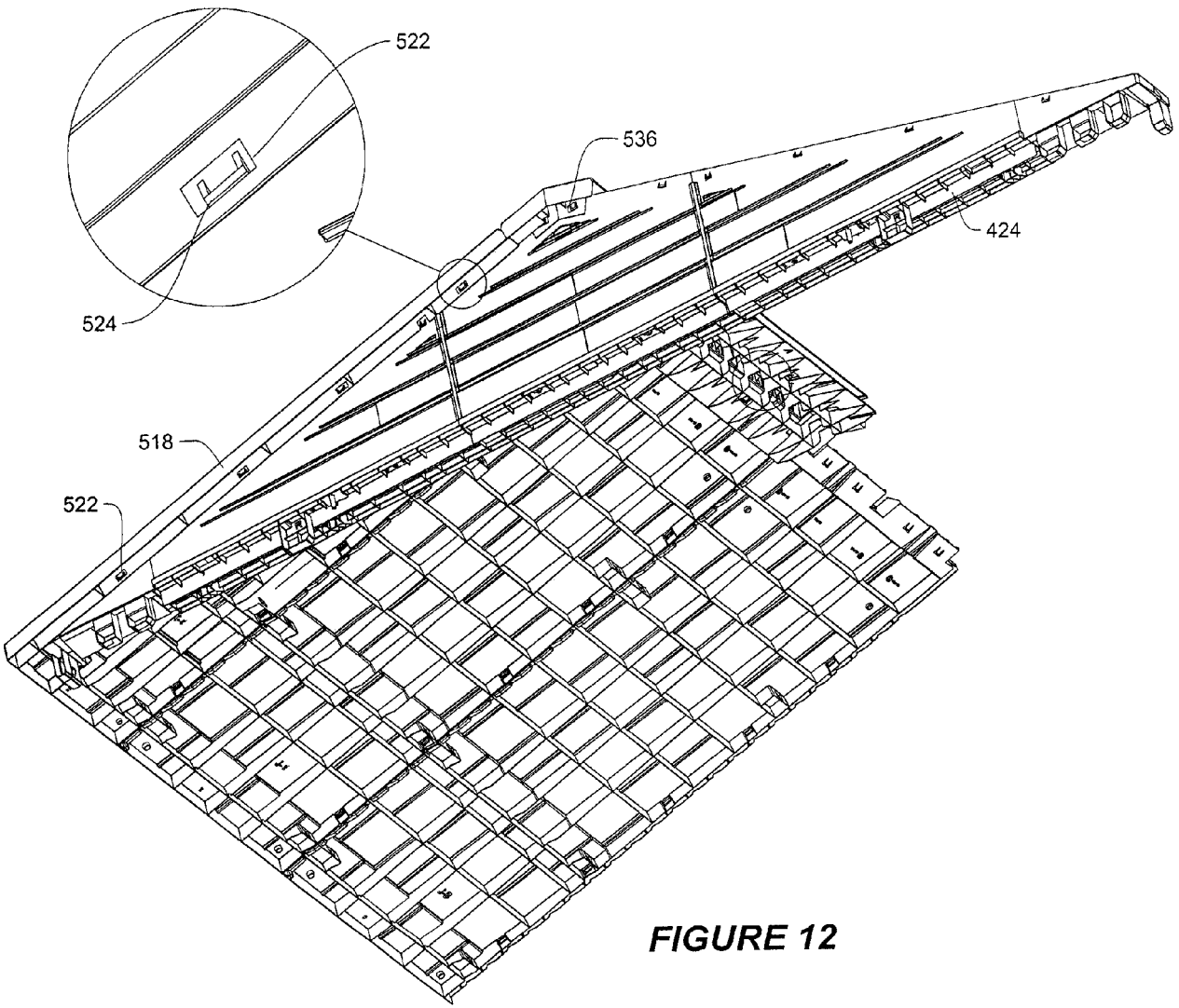
FIG. 12 is a perspective view of the front side of a header and the underside of roof panels.
FIG. 12A is an enlarged view of the connection between the header and a roof panel.

The end roof panels 464 are similar to the central roof panels in that they have a top surface, a bottom surface, sockets 478 on the bottom surface located along either a first or second locking edge, a third locking edge and a closed end. They differ from the central roof panels in that they are not as wide and have a channel 516 located along either a first or second locking edge. In place of a locking edge adjacent the channel there is a smooth edge surface 518 (FIGS. 3 and 12). This edge extends beyond the header and presents an aesthetically pleasing surface. The width of channel 516 is the same as the depth of the header assemblies 410 so as to form a connection between the roof and the header assemblies and create a weather resistant seal between the two members. Channels 516 are also include apertures 522 which engage ramp-locks 524 located along the upper edge of the header assemblies (FIG. 12) to secure the end roof panels to the header assemblies.

Figure 14:
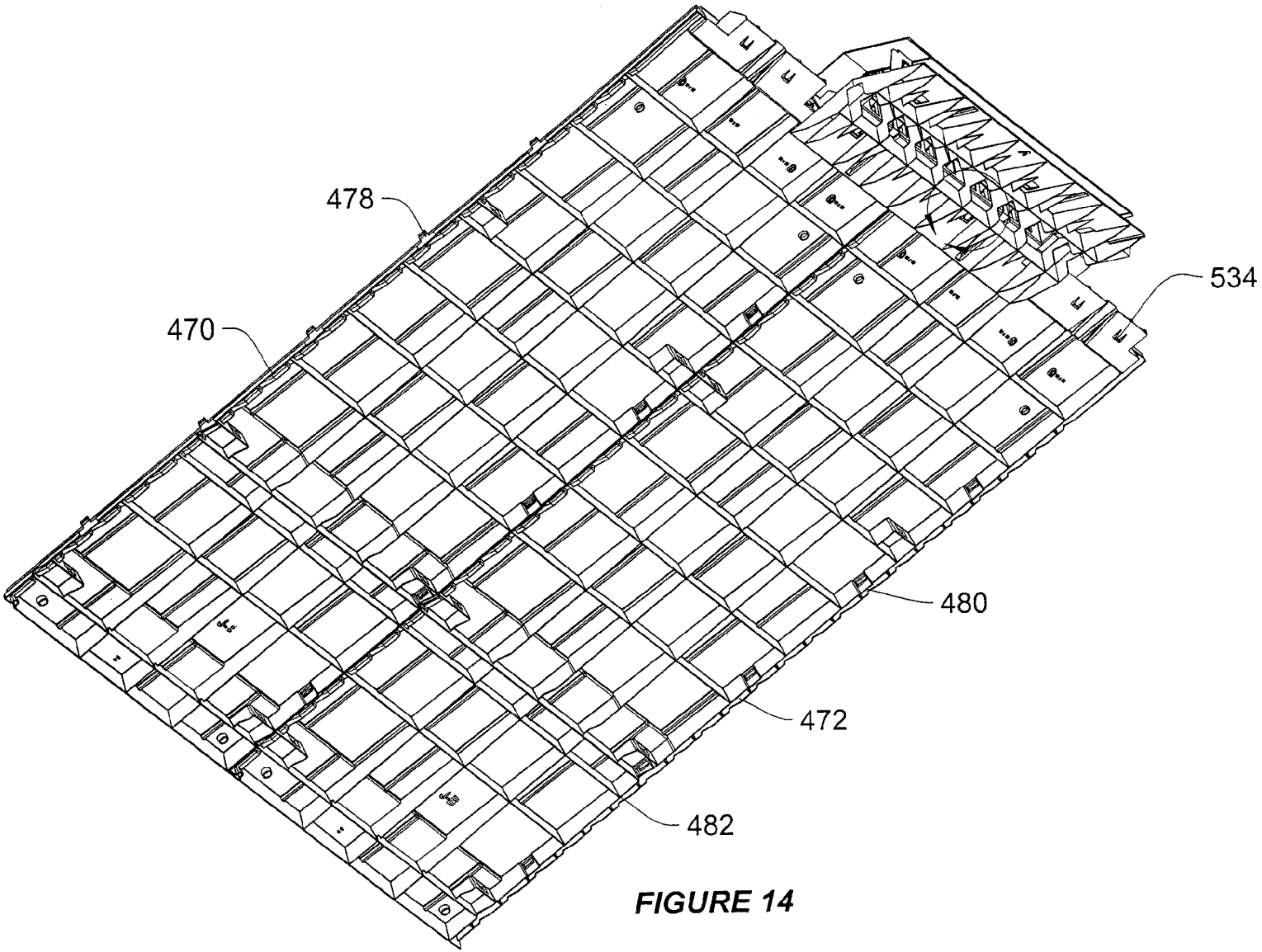
FIG. 14 is a perspective view of the underside of the roof panels and a section of the ridge cap.
Figure 19:
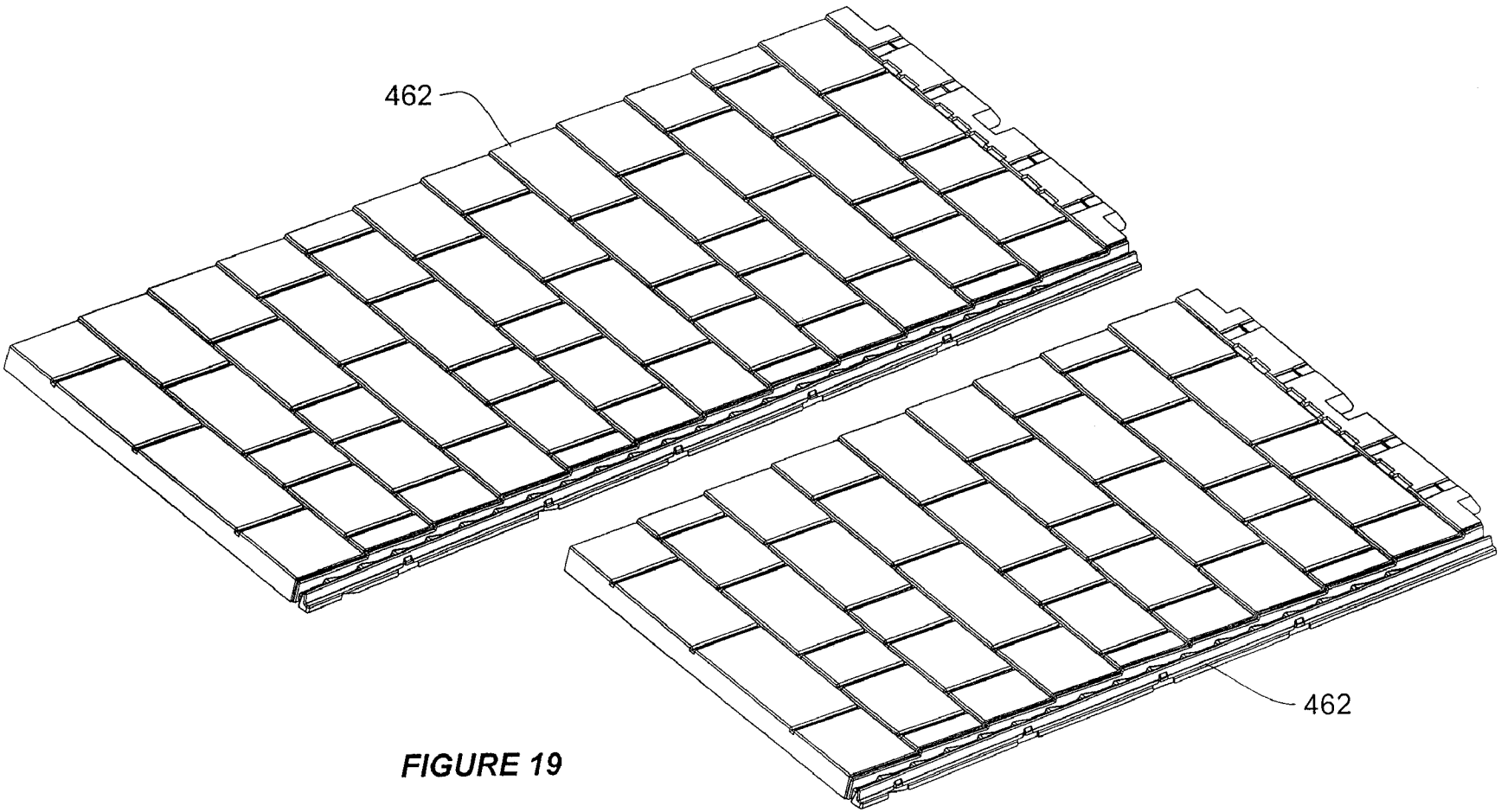
FIG. 19 is a perspective view of two different roof panels utilized for enclosures of different widths.

The central and end roof panels are available in at least two different lengths as shown in FIG. 19. The pattern of the structural ribs 482 on the bottom surface of the roof panels is selected so that the shorter roof panel can be formed without retooling. As can be seen in FIG. 14 if the formation of the roof panel is stopped at the transverse rib 482 a shorter roof panel, with the proper structural elements, will be the result.

The roof assembly also includes a ridge cap assembly 530 which is formed from a plurality of like constructed ridge cap members 531 (FIG. 13). Each ridge cap member includes an integrally formed tubular connector 533 at one end thereof and an integrally formed aperture 532 at the opposite end thereof. The tubular connector 533 of one ridge cap member engages the aperture 532 of an adjacent ridge cap member thereby interlocking the members together. There are also two ridge cap members which cooperate with the end roof panels and header assemblies (FIG. 3) and include apertures 536 which cooperate with ramp-locks 524 formed on the header assemblies (FIG. 12) to secure the ridge cap members to the header assemblies. Each of these ridge cap members is formed with an end portion which corresponds to the edge surface 518 of the end roof panels so as to present an aesthetically pleasing edge surface when located adjacent thereto. The ridge cap members may be made from a translucent material to enhance natural lighting of said enclosure.

Figure 15:
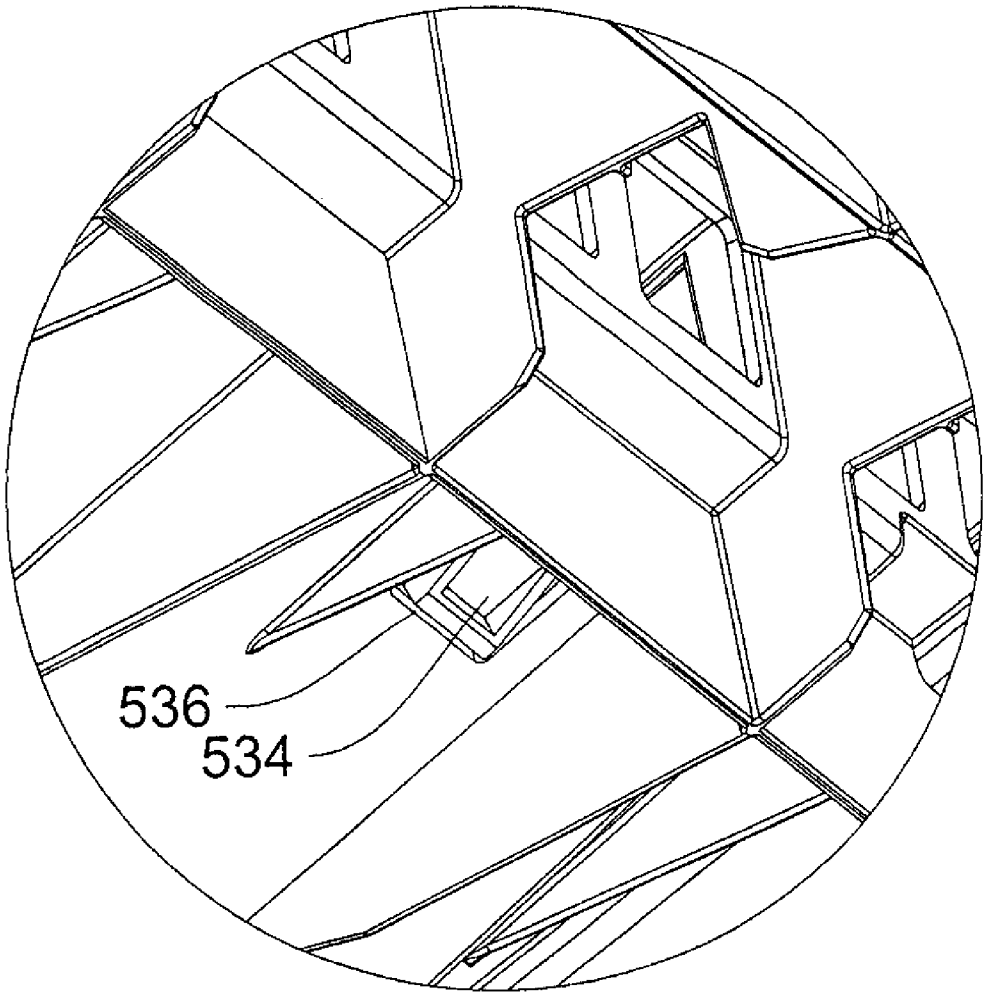
FIG. 15 is an enlarged view taken along line 2-2 of FIG. 14 illustrating the connection between the ridge cap and a roof panel.

The third locking edge of each roof panel includes an interlocking tubular connection 526 which is constructed and arranged to cooperate with a conjugately shaped receiver 528 formed in the ridge cap members 531 (FIG. 3) to join roof panels on opposite sides of the roof and to create a weather resistant seal. The tubular connection 526 includes integrally formed ramp-locks 534 which engage corresponding apertures 536 in the ridge cap members (FIG. 15). The length of each ridge cap corresponds to the width of a roof panel.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A plastic roof assembly comprising:

at least two like configured roof panels, wherein each said roof panel includes a first edge, a second edge opposite to and substantially parallel to said first edge, said first and said second edges including a first connector connecting juxtaposed roof panels together, said first connector includes a plurality of ramp locks located along one of said first and said second edges, a plurality of apertures located along the other of said first and said second edges, said apertures receiving said ramp locks therein and forming a connection between said juxtaposed roof panels, a third edge substantially perpendicular to and extending between said first and said second edges, a fourth edge opposite to and substantially parallel to said third edge, said fourth edge is closed, a top surface and a bottom surface, said two roof panels having said first and said second edges juxtapositioned in interlocking engagement to assemble a roof assembly having a predetermined width, a ridge cap assembly, said ridge cap assembly includes a plurality of like constructed ridge cap members, wherein said ridge cap members each include an upper surface, a lower surface, a first end, a second end, a first edge and a second edge, said first end and said second end include integrally formed ridge cap connectors, said ridge cap connectors securing said ridge cap members together in interfitting engagement to provide a weather resistant seal at the peak of the roof, further including at least one tubular member positioned along said third edge of said roof panel and at least one receiver integrally formed on a first and a second edge of said ridge cap member, said tubular member being constructed and arranged to engage said receiver to connect roof panels positioned on opposite sides of the roof together to form the roof wherein said roof assembly may be shipped in a disassembled state and assembled on a desired site.

2. The plastic roof assembly of claim 1 further including a third connector, said third connector including a rib extending downwardly from said top surface of said roof panel along one of said first and said second edges, a upwardly extending trough constructed and arranged to receive said rib extending along the other of said first and said second edges, said upwardly extending trough including an integrally formed drain adjacent said fourth edge whereby any moisture which may penetrate the joint of adjacent roof panels enters said trough and is carried along said trough and expelled out said drain so as to not pass through said roof assembly and into a utility shed there below.

3. The plastic roof assembly of claim 1 wherein a second connector connecting roof panels together, said second connector includes a plurality of sockets on the bottom surface of said roof panel and spaced along said first and said second edge, said sockets positioned on and juxtaposed said first and said second edges being positioned directly opposite each other, a roof connector constructed and arranged to engage said juxtaposed sockets to provide an additional connection for connecting said roof panels together.

4. The plastic roof assembly of claim 3 wherein said second connector is located proximate said fourth edge of said roof panel and is constructed and arranged to engage a socket located in an upper portion of a wall panel.

5. The plastic roof assembly of claim 3 wherein said second connector is located between and spaced from said third and said fourth edges and is constructed and arranged to engage a roof support extending below and along the length of said roof whereby loads received by said roof are substantially transferred to a wall assembly.

6. The plastic roof assembly of claim 5 wherein said roof support is constructed of metal.

7. The plastic roof assembly of claim 5 wherein said roof support is constructed of plastic.

8. The plastic roof assembly of claim 5 wherein said roof support is constructed of wood.

9. The plastic roof assembly of claim 5 wherein said roof support is constructed of a composite material.

10. The plastic roof assembly of claim 1 wherein said ridge cap assembly is constructed of a translucent material.

11. Plastic roof assembly comprising:

at least two like configured roof panels, wherein each said roof panel includes a first edge, a second edge opposite to and substantially parallel to said first edge, said first and said second edges including a first connector connecting juxtaposed roof panels together, said first connector includes a plurality of ramp locks located along one of said first and said second edges, a plurality of apertures located along the other of said first and said second edges, said apertures receiving said ramp locks therein and forming a connection between said juxtaposed roof panels, a third edge substantially perpendicular to and extending between said first and said second edges, a fourth edge opposite to and substantially parallel to said third edge, said fourth edge is closed, a top surface and a bottom surface, said two roof panels having said first and said second edges juxtapositioned in interlocking engagement to assemble a roof assembly having a predetermined width, further including at least two header assemblies, each said header assembly including at least two header members constructed and arranged to support a plurality of roof panels at a predetermined pitch, said header members including an upper surface, a lower surface and an end surface, said end surfaces including a plurality of integrally formed inter-fitting tubes separated by inwardly extending sockets, wherein said tubes are constructed and arranged to fit within said sockets for interlocking engagement thereby attaching said at least two header members together wherein said roof assembly may be shipped in a disassembled state and assembled on a desired site.

12. The plastic roof assembly of claim 11 wherein said lower surface of said header member includes integrally formed sockets, a plurality of individually formed bosses are constructed and arranged to engage both said integrally formed sockets on said lower surface of said header member and sockets located in the upper portions of a wall panel to provide structural support for said header members.

13. The plastic roof assembly of claim 11 further including a support member extending substantially the length of said at least two header members, said support member secured to said at least two header members with suitable fasteners.

14. The plastic roof assembly of claim 11 further including at least one C-shaped clip constructed and arranged to cooperate with apertures formed adjacent an end surface of each of said header members.

15. The plastic roof assembly of claim 11 wherein said header assembly includes three separable header members which together form said header assembly.

16. The plastic roof assembly of claim 11 wherein said header members further include a plurality of pockets located adjacent said upper surface, said plurality of pockets are constructed and arranged to receive a first end of at least one roof support said plurality of pockets constructed and arranged to secure said at least one roof support in a position to provide structural support to said at least two roof panels.

17. The plastic roof assembly of claim 11 further including end roof panels, said end roof panels include a first or second edge, a channel substantially parallel to said first or second edge, a third edge and a closed fourth edge, said channel is constructed and arranged to engage the upper surface and top portion of said header members to provide support for said roof panel, said first or second edge is constructed and arranged to engage a corresponding first or second edge of said roof panel, said third edge is constructed and arranged to engage said ridge cap assembly, whereby when said end roof panels are connected to said roof panels and said end roof panels and roof panels are connected to said ridge cap assembly a roof assembly is formed.

* * * * *